US006782674B2

(12) United States Patent
Spatafora

(10) Patent No.: US 6,782,674 B2
(45) Date of Patent: Aug. 31, 2004

(54) CIGARETTE PACKING MACHINE

(75) Inventor: Mario Spatafora, Bologna (IT)

(73) Assignee: G.D Societa' per Azioni, Pomponia (IT)

( * ) Notice: Subject to any disclaimer, the term of this patent is extended or adjusted under 35 U.S.C. 154(b) by 121 days.

(21) Appl. No.: 09/864,991

(22) Filed: May 24, 2001

(65) Prior Publication Data

US 2001/0047923 A1 Dec. 6, 2001

(30) Foreign Application Priority Data

May 30, 2000 (IT) ..... BO2000A0323

(51) Int. Cl.[7] ..... B65B 35/30
(52) U.S. Cl. ..... 53/148
(58) Field of Search ..... 53/148, 150, 152, 53/535, 151, 255, 260; 131/282, 283

(56) References Cited

U.S. PATENT DOCUMENTS 3,869,035 A 3/1975 Focke
4,646,938 A 3/1987 Focke
4,731,975 A * 3/1988 Rossier ..... 53/148
5,010,929 A * 4/1991 Tisma ..... 141/1
5,961,000 A * 10/1999 Sanfilippo et al. ..... 222/152
5,979,458 A * 11/1999 Meis ..... 131/283
6,463,716 B1 * 10/2002 Focke et al. ..... 53/370.3

* cited by examiner

*Primary Examiner*—Eugene Kim
*Assistant Examiner*—John Paradiso
(74) *Attorney, Agent, or Firm*—Marshall, Gerstein & Borun LLP

(57) ABSTRACT

A cigarette packing machine wherein a hopper for housing a mass of cigarettes has at least two outlets, each for feeding groups of cigarettes successively to respective pockets of a conveyor through a respective lateral output opening and through a tubular connecting member, which is connected to an actuating device for moving the tubular member into a maintenance position to permit access from the outside to the tubular member, and at the same time to close a respective access to the conveyor.

22 Claims, 4 Drawing Sheets

CIGARETTE PACKING MACHINE

BACKGROUND OF THE INVENTION

On known packing machines, the cigarettes are housed in bulk inside a hopper having a number of substantially vertical outlets, down each of which the cigarettes travel by force of gravity to form, on a bottom stop plate, a column, a bottom portion of which is defined by an orderly group of cigarettes defining the content of a packet and positioned facing a lateral output opening of the outlet. By means of a pusher, the group is then transferred through the lateral output opening and a tubular connecting member into a respective pocket on a conveyor operated in steps so as to position, at each step, an empty pocket with its input facing a respective tubular connecting member.

When transferring the groups, clogging may occur due to incorrect positioning of the cigarettes, thus calling for normally manual intervention to clear the clogged areas.

On known packing machines, the tubular connecting members of the lateral output openings of the hopper outlets are only accessible externally through the respective conveyor pockets, so that the packing machine must be stopped to clear any one of the tubular connecting members.

SUMMARY OF THE INVENTION

It is an object of the present invention to provide a packing machine designed to eliminate the aforementioned drawbacks.

According to the present invention, there is provided a cigarette packing machine comprising an input hopper having at least two outlets, each of which has a respective lateral output opening for a respective succession of groups of cigarettes; conveying means comprising a number of pockets, each for receiving a respective said group from a respective said output opening, and for feeding the group in a given direction; and, for each said outlet, a transfer unit for transferring each relative said group from the relative output opening to the relative said pocket through a respective access to the pocket; the transfer unit comprising connecting means for connecting the relative said output opening to the relative said access; characterized in that each said transfer unit also comprises actuating means for moving said connecting means between a connecting work position and a maintenance position in which said connecting means are accessible from outside.

BRIEF DESCRIPTION OF THE DRAWINGS

A number of non-limiting embodiments of the invention will be described by way of example with reference to the accompanying drawings, in which.

DETAILED DESCRIPTION OF THE INVENTION

Figure 1:
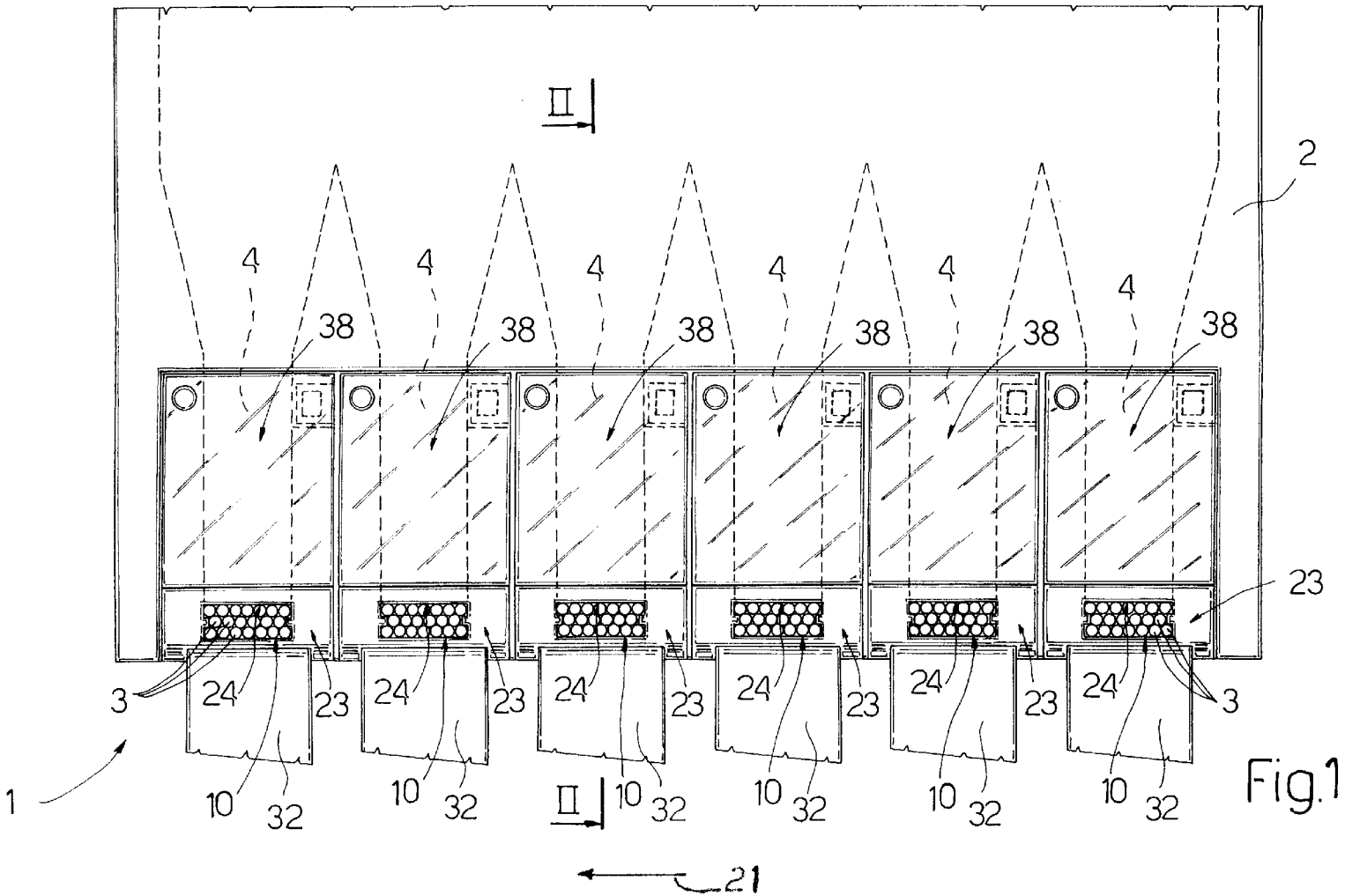
FIG. 1 shows a schematic side view of an input portion of a cigarette packing machine in accordance with the teachings of the present invention.

Number 1 in FIG. 1 indicates as a whole a cigarette packing machine comprising an input hopper 2 for housing a mass (not shown) of cigarettes 3 (FIG. 2) and having a number n of substantially vertical outlets 4.

Figure 3:
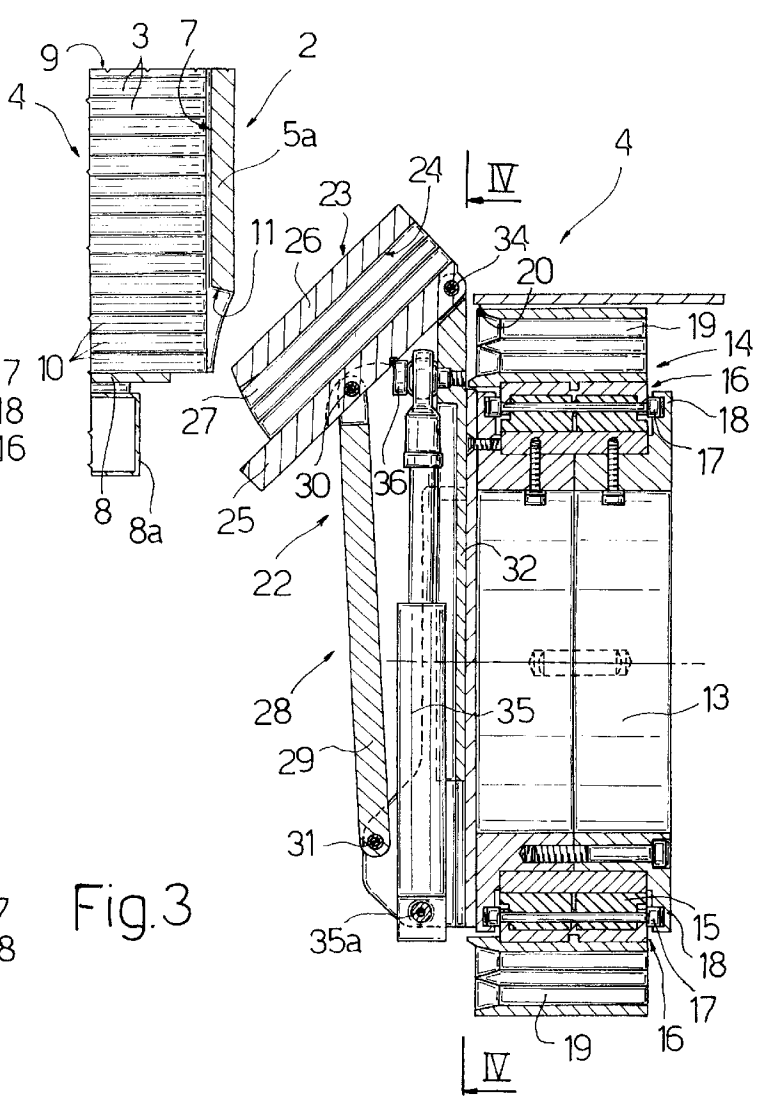
FIG. 3 shows the FIG. 2 section in a second operating position.
Figure 2:
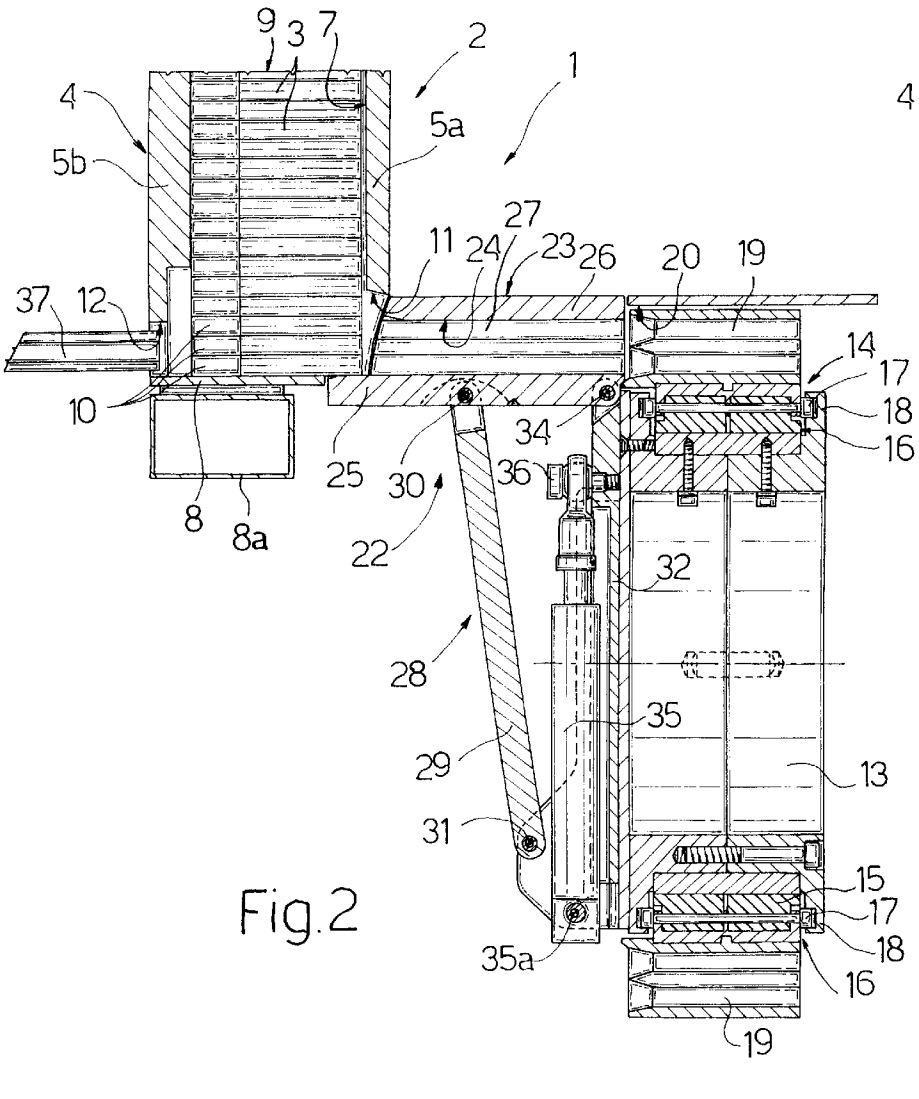
FIG. 2 shows a cross section along line II—II in FIG. 1 in a first operating position.

As shown in FIGS. 2 and 3, each outlet 4 is defined laterally by a front wall 5*a* and a rear wall 5*b*, which are made integral with each other by two lateral walls 6 (only shown in FIG. 6) perpendicular to walls 5*a* and 5*b*, are perpendicular to cigarettes 3, and define in between a channel 7 of a width approximately equal to but no less than the length of cigarettes 3. Cigarettes 3 travel transversely by force of gravity along channel 7 to form, on a stop plate 8 supported by a fixed cross member 8*a* and defining a bottom end member of outlet 4, a column 9, a bottom portion of which is defined by a group 10 of cigarettes 3 arranged in three superimposed layers and defining the content of a packet (not shown) of cigarettes.

Inside each outlet 4, the relative group 10 is positioned facing an output opening 11 formed in the bottom of front wall 5*a* of outlet 4, just over stop plate 8, and facing a further opening 12 formed in the bottom of wall 5*b*.

Packing machine 1 also comprises a frame 13 facing outlets 4 and supporting a known endless conveyor 14, which comprises a continuous belt 15 fitted with a number of carriages 16 equally spaced along belt 15. Each carriage 16 has two pairs of wheels 17 engaging two guides 18 formed on frame 13, and defines a respective pocket 19 for housing a relative group 10.

Pockets 19 are accessible laterally through an access opening 20 formed in frame 13 and facing output openings 11 of outlets 4, and conveyor 14 is a step conveyor traveling in steps of a length equal to the space occupied by n pockets 19, and in a substantially horizontal direction 21 (FIG. 1) crosswise to the FIGS. 2 and 3 plane and to cigarettes 3, so as to position, at each step, an empty pocket 19 directly facing a respective output opening 11.

Packing machine 1 also comprises, for each outlet 4, a transfer unit 22 for transferring each relative group 10 from channel 7 to the relative pocket 19 through relative output opening 11.

As shown in FIGS. 2 and 3, each transfer unit 22 comprises a tubular member 23 interposed between relative output opening 11 and conveyor 14, and extending in a direction crosswise to direction 21. Tubular member 23 comprises a straight, substantially rectangular-section inner conduit 24 sized to permit the passage of a group 10, and defined by a bottom wall 25 and top wall 26 parallel to each other, and by two lateral walls 27 parallel to each other and perpendicular to walls 25 and 26.

Figure 4:
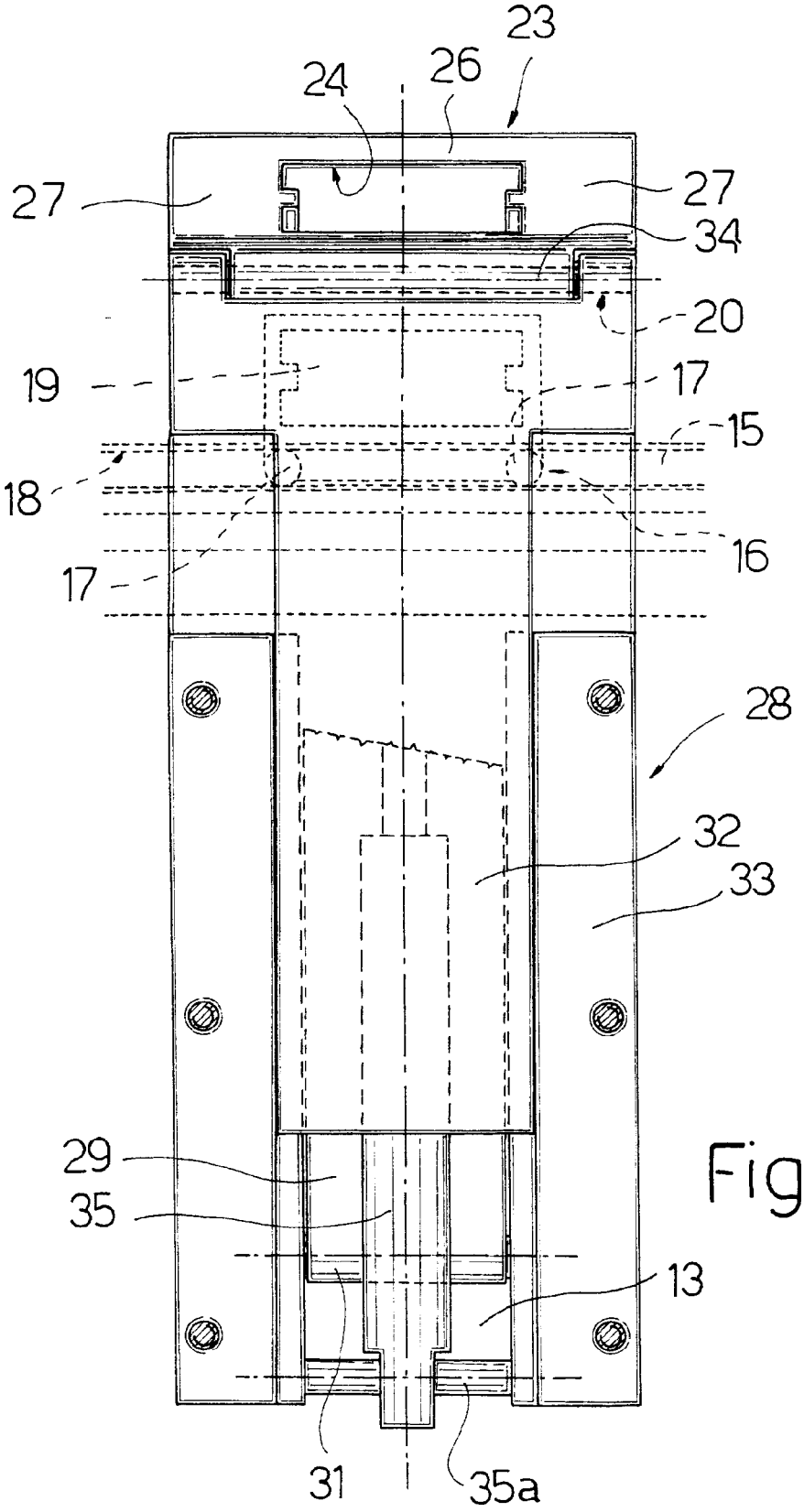
FIG. 4 shows a larger-scale section along line IV—IV in FIG. 3.

Transfer unit 22 also comprises a supporting and actuating device 28 interposed between frame 13 and tubular member 23 and for moving tubular member 23 between a work position (FIG. 2) in which bottom wall 25 is aligned with stop plate 8, and a maintenance position (FIGS. 3 and 4) in which tubular member 23 is rotated a given angle with respect to the work position.

In the work position, conduit 24 communicates with relative output opening 11 and access opening 20 to permit the passage of groups 10 from channel 7 to respective pockets 19 when conveyor 14 stops, whereas the maintenance position permits access to conduit 24 from the outside to clear conduit 24 in the event of clogging.

Supporting and actuating device 28 comprises a rod 29 located beneath tubular member 23 and connected to an intermediate point on bottom wall 25 of tubular member 23 by a hinge 30 with an axis parallel to direction 21, and to a point on frame 13 by a hinge 31 with an axis also parallel to direction 21. Supporting and actuating device 28 also comprises a slide 32, which is mounted to slide along a guide 33 integral with frame 13, beneath access opening 20, and crosswise to direction 21, and is connected to the end of tubular member 23 facing access opening 20 by means of a hinge 34 parallel to direction 21. Finally, supporting and actuating device 28 comprises a linear actuator 35 extending along guide 33 and having a first end hinged to frame 13 at a hinge 35*a*, and a second end connected to slide 32 by a connecting pin 36.

Transfer unit 22 also comprises a pusher 37 movable back and forth through opening 12 and channel 7 and along conduit 24, when tubular member 23 is in the work position, to feed groups 10 successively into respective pockets 19 in the course of respective stops by conveyor 14.

Operation of packing machine 1, and in particular of transfer unit 22, is clear from the foregoing description and FIGS. 2 and 3, and therefore requires no further explanation.

It should be pointed out, however, that, when supply of groups 10 from any one of outlets 4 of machine 1 is interrupted by clogging of relative conduit 24, operation of relative actuator 35 by the operator not only provides for rotating tubular member 23 about the axis of hinge 30 in one direction (anticlockwise in FIGS. 2 and 3) and simultaneously rotating hinge 30 about the axis of hinge 31 in the opposite direction to permit access from the outside to the two opposite ends of conduit 24 and to relative output opening 11, but also for moving slide 32 from a lowered rest position to a raised work position, in which a top portion of slide 32 closes the portion of access opening 20 in front of relative tubular member 23, thus enabling the operator to clear conduit 24 safely even without stopping conveyor 14.

The protection afforded by slides 32 when servicing relative conduits 24 is particularly advantageous in that, when any one of tubular members 23 becomes clogged and is accordingly moved into the FIG. 3 maintenance position, the relative group 10 is not supplied to relative pocket 19 and conveyor 14 can be kept moving. In known manner not described, packing machine 1 detects the repeated absence of a group 10 every n pockets 19, and is able to keep operating by simply suspending, in known manner, all the packing operations relative to the missing groups 10.

Figure 5:
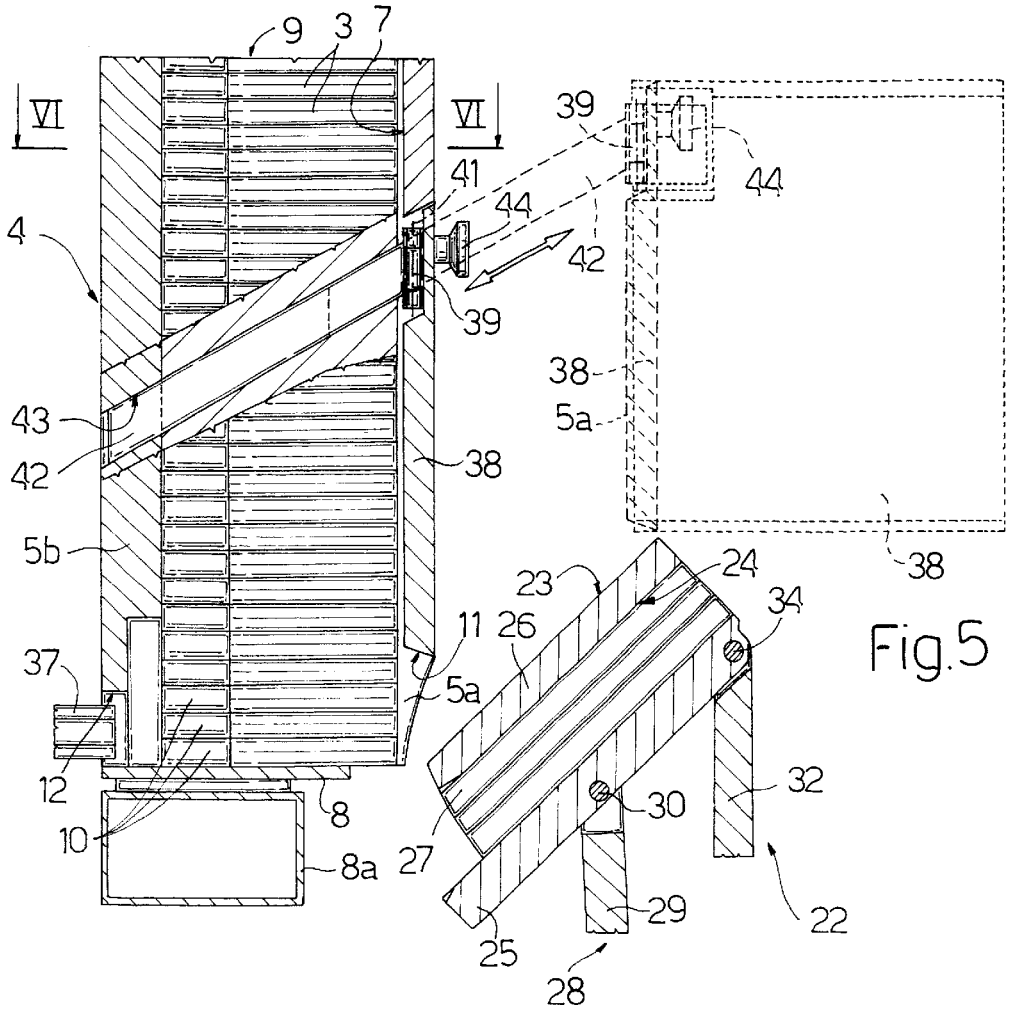
FIG. 5 shows a variation of a detail in the FIG. 3 section.
Figure 6:
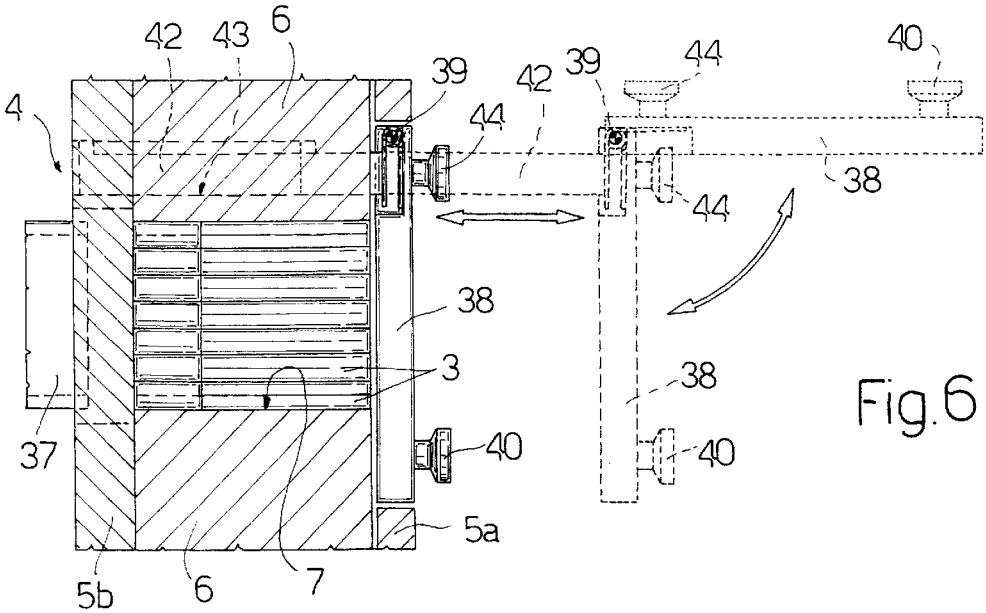
FIG. 6 shows a section along line VI—VI in FIG. 5.

In the FIGS. 5 and 6 variation, front wall 5*a* of each outlet 4 is defined partly by a hatch 38, a bottom edge of which defines a top end of relative output opening 11, and a lateral edge of which is connected to one of lateral walls 6 of outlet 4 by a hinge 39. Close to the lateral edge opposite the one fitted with hinge 39, hatch 38 is fitted with a knob 40 by which to rotate hatch 38, about an axis 41 of hinge 39 crosswise to cigarettes 3, from a closed position (shown by the continuous line) to an open position (shown by the dash line in FIGS. 5 and 6) permitting access to channel 7 from the outside for maintenance purposes.

As shown clearly in FIG. 5, however, hatch 38 cannot be opened when tubular member 23 is in the maintenance position. For which reason, hinge 39 is connected to relative wall 6, not directly, but by the interposition of a slide defined by a rod 42 mounted to slide inside a guide defined by a hole 43 formed in the thickness of wall 6 and sloping downwards from the front end; and hatch 38 has a further knob 44 by which the operator slides rod 42 along hole 43 to move hatch 38, still in the closed position, into an intermediate position (shown by the dash line in FIGS. 5 and 6) over tubular member 23 (FIG. 5) in the maintenance position. At which point, the operator can rotate hatch 38 about axis 41 without interfering with tubular member 23, and service channel 7 even with tubular member 23 in the maintenance position.

It should be pointed out that each group 10 of cigarettes 3 may comprise one or any number of layers of cigarettes 3, and may comprise fewer cigarettes 3 than the number housable inside pocket 19.

What is claimed is:

1. A cigarette packing machine comprising an input hopper (2) having at least two outlets (4), each of which has a respective lateral output opening (11) for a respective succession of groups (10) of cigarettes; conveying means (14) comprising a number of pockets (19), each for receiving a respective said group (10) from a respective said output opening (11), and for feeding the group in a given direction (21); and, for each said outlet (4), a transfer unit (22) for transferring each relative said group (10) from the relative output opening (11) to the relative said pocket (19) through a respective access (20) to the pocket (19); the transfer unit (22) comprising connecting means (23) for connecting the relative said output opening (11) to the relative said access (20); wherein each said transfer unit (22) also comprises actuating means (35) for moving said connecting means (23) between a connecting work position and a maintenance position in which said connecting means (23) are accessible from outside.

2. The machine of claim 1, wherein said connecting means (23), when in said maintenance position, permit access from the outside to the relative said output opening (11).

3. The machine of claim 1, wherein connecting means (23) are mounted so as to be rotated by said actuating means (35) about at least one axis (30, 31) of rotation.

4. The machine of claim 3, wherein said axis (30, 31) of rotation is parallel to said direction (21).

5. The machine of claim 2, wherein said connecting means (23) are mounted so as to be rotated by said actuating means (35) about a first axis (30) of rotation parallel to said direction (21) and in turn movable about a second axis (31) of rotation parallel to said first axis (30) of rotation.

6. The machine of claim 1, wherein each said transfer unit (22) comprises closing means (32) movable with the respective said connecting means (23) to close the respective said access (20) when said connecting means (23) are in said maintenance position.

7. The machine of claim 1, wherein said connecting means (23) comprise a tubular member (23), which is interposed between the respective said output opening (11) and the respective said access (20) to said conveying means (14), and is movable, by the relative said actuating means (35), between said work position wherein said tubular member (23) is aligned with the relative said output opening (11) and with the relative said access (20), and said maintenance position wherein said tubular member (23) is out of line with respect to both the relative said output opening (11) and the relative said access (20).

8. The machine of claim 7, wherein said transfer unit (22) also comprises a fixed frame (13), and a rod (29) having a first hinge (30) connecting the rod (29) to an intermediate point on said tubular member (23), said first hinge (30) having a first axis parallel to said direction (21); and a second hinge (31) connecting the rod (29) to a point on said frame (13), said second hinge (31) having a second axis parallel to said direction (21).

9. The machine of claim 8, wherein said transfer unit (22) also comprises a slide (32) mounted to slide along a guide (33) integral with said frame (13) and crosswise to said direction (21); said slide (32) being connected, by a third hinge (34) parallel to said direction (21), to an end of said tubular member (23) facing said access (20), so as to be moved by said actuating means (35) into a closed position closing the relative said access (20) when said tubular member (23) is moved into said maintenance position.

10. The machine of claim 8, wherein said actuating means (35) are interposed between said frame (13) and said slide (32).

11. The machine of claim 8, wherein said frame (13) supports said conveying means (14).

12. The machine of claim 1, wherein each said outlet (4) comprises a first wall (5*a*) facing said connecting means (23) and having said output opening (11); said first wall (5*a*) comprising a hatch (38) above said output opening (11); a hinge (39) being interposed between said hatch (38) and the relative said outlet (4) to permit rotation of the hatch (38) between a closed position and an open position respectively closing and opening the relative outlet (4); a guide (43) being formed in said outlet (4) crosswise to said first wall (5*a*), and sloping downwards from the first wall (5*a*); and a slide (42) being mounted to slide along said guide (43), and being fitted on the top end with said hinge.

13. A cigarette packing machine comprising an input hopper (2) having at least two outlets (4), each of which has a respective lateral output opening (11) for a respective succession of groups (10) of cigarettes; conveying means (14) comprising a number of pockets (19), each for receiving a respective said group (10) from a respective said output opening (11), and for feeding the group in a given direction (21); and, for each said outlet (4), a transfer unit (22) for transferring each relative said group (10) from the relative output opening (11) to the relative said pocket (19) through a respective access (20) to the pocket (19); the transfer unit (22) comprising connecting means (23) for connecting the relative said output opening (11) to the relative said access (20); wherein each said transfer unit (22) also comprises actuating means (35) for moving said connecting means (23) between a connecting work position and a maintenance position in which said connecting means (23) are accessible from outside and permit access from the outside to the relative said output opening (11); each said transfer unit (22) comprising closing means (32) movable with the respective said connecting means (23) to close the respective said access (20) when said connecting means (23) are in said maintenance position.

14. The machine of claim 13, wherein connecting means (23) are mounted so as to be rotated by said actuating means (35) about at least one axis (30, 31) of rotation.

15. The machine of claim 14, wherein said axis (30, 31) of rotation is parallel to said direction (21).

16. The machine of claim 13, wherein said connecting means (23) are mounted so as to be rotated by said actuating means (35) about a first axis (30) of rotation parallel to said direction (21) and in turn movable about a second axis (31) of rotation parallel to said first axis (30) of rotation.

17. The machine of claim 13, wherein said connecting means (23) comprise a tubular member (23), which is interposed between the respective said output opening (11) and the respective said access (20) to said conveying means (14), and is movable, by the relative said actuating means (35), between said work position wherein said tubular member (23) is aligned with the relative said output opening (11) and with the relative said access (20), and said maintenance position wherein said tubular member (23) is out of line with respect to both the relative said output opening (11) and the relative said access (20).

18. The machine of claim 17, wherein said transfer unit (22) also comprises a fixed frame (13), and a rod (29) having a first hinge (30) connecting the rod (29) to an intermediate point on said tubular member (23), said first hinge (30) having a first axis parallel to said direction (21); and a second hinge (31) connecting the rod (29) to a point on said frame (13), said second hinge (31) having a second axis parallel to said direction (21).

19. The machine of claim 18, wherein said transfer unit (22) also comprises a slide (32) mounted to slide along a guide (33) integral with said frame (13) and crosswise to said direction (21); said slide (32) being connected, by a third hinge (34) parallel to said direction (21), to an end of said tubular member (23) facing said access (20), so as to be moved by said actuating means (35) into a closed position closing the relative said access (20) when said tubular member (23) is moved into said maintenance position.

20. The machine of claim 19, wherein said actuating means (35) are interposed between said frame (13) and said slide (32).

21. The machine of claim 18, wherein said frame (13) supports said conveying means (14).

22. The machine of claim 13, wherein each said outlet (4) comprises a first wall (5*a*) facing said connecting means (23) and having said output opening (11); said first wall (5*a*) comprising a hatch (38) above said output opening (11); a hinge (39) being interposed between said hatch (38) and the relative said outlet (4) to permit rotation of the hatch (38) between a closed position and an open position respectively closing and opening the relative outlet (4); a guide (43) being formed in said outlet (4) crosswise to said first wall (5*a*), and sloping downwards from the first wall (5*a*); and a slide (42) being mounted to slide along said guide (43), and being fitted on the top end with said hinge.

* * * * *